US005429023A

United States Patent [19]

Imaizumi

[11] Patent Number: 5,429,023

[45] Date of Patent: Jul. 4, 1995

[54] AUTOMATIC PERFORMANCE DEVICE HAVING A TEMPO CHANGING FUNCTION THAT CHANGES THE TEMPO AND AUTOMATICALLY RESTORES THE TEMPO TO THE PREVIOUS VALUE

[75] Inventor: Tsutomu Imaizumi, Hamamatsu, Japan

[73] Assignee: Yamaha Corporation, Hamamatsu, Japan

[21] Appl. No.: 33,179

[22] Filed: Mar. 16, 1993

[30] Foreign Application Priority Data

Mar. 18, 1992 [JP] Japan ..... 4-091472

[51] Int. Cl.[6] ..... G10H 1/40

[52] U.S. Cl. ..... 84/612; 84/636

[58] Field of Search ..... 84/601, 602, 611, 612, 84/635, 636, 668, DIG. 12

[56] References Cited

U.S. PATENT DOCUMENTS

| | | | |
|---|---|---|---|
| 4,655,113 | 4/1987 | Bunger et al. | 84/DIG. 12 |
| 5,220,120 | 6/1993 | Mukaino | 84/636 |
| 5,221,801 | 6/1993 | Bruti et al. | 84/636 |
| 5,227,574 | 7/1993 | Mukaino | 84/668 |
| 5,300,728 | 4/1994 | Shimada | 84/636 |

FOREIGN PATENT DOCUMENTS

| | | |
|---|---|---|
| 57-52593 | 11/1982 | Japan . |
| 59-88795 | 5/1984 | Japan . |
| 0286851 | 12/1991 | Japan . |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

Tempo information representing a performance tempo set at start of an automatic performance is stored in a first register. A tempo restoration switch is provided for reading out the tempo information from the first register and setting the tempo of the automatic performance by this tempo information. Even when the performance tempo is changed freely during the automatic performance, the tempo at the start of the automatic performance can be restored automatically by operating the tempo restoration switch. Tempo information representing a performance tempo set before start of tempo changing may be stored in a second register. A second tempo restoration switch may be provided for reading out the tempo information from this second register and setting the tempo of the autoamtic performance by this tempo information. Even when the performance tempo is changed freely during the automatic performance, the tempo before start of the tempo changing can be restored automatically by operating the second tempo restoration switch. Control of tempo primo and a tempo is thereby facilitated.

18 Claims, 9 Drawing Sheets

AUTOMATIC PERFORMANCE DEVICE HAVING A TEMPO CHANGING FUNCTION THAT CHANGES THE TEMPO AND AUTOMATICALLY RESTORES THE TEMPO TO THE PREVIOUS VALUE

BACKGROUND OF THE INVENTION

This invention relates to an automatic performance device such as a sequencer, an automatic accompaniment device, an automatic rhythm performance device or the like device used in an electronic musical instrument and, more particularly, to an automatic performance device having a function of changing a tempo during an automatic performance.

In the prior art, there is known an automatic performance device of a type which stores performance information supplied from a keyboard of an electronic musical instrument or a computer and reproduces a tone played on the basis of the stored performance information. In this type of automatic performance device, performance information is read from a memory in accordance with a tempo clock and a tone signal is generated on the basis of this performance information. In this case, the frequency of the tempo clock can be freely variably controlled by operating a tempo setting switch or the like and, therefore, the operator or player can freely change the tempo of playback performance to a desired tempo by operating such tempo setting switch or the like.

The tempo of performance can be changed continuously by operation of the tempo setting switch or discontinuously by operation of a suitable up-down switch or the like switch. There has also recently appeared a device according to which the tempo of performance can be decelerated or accelerated gradually at a certain rate by operation of switches such as a ritardando switch and an accelerando switch corresponding to tempo words such as ritardando and accelerando.

In the prior art automatic performance devices, the performance tempo is changed continuously or discontinuously by changing the performance tempo during performance by means of a tempo setting operator in the form of a knob or a switch and the tempo of a music piece performed thereby is variably changed and variety is imparted to the music piece performed.

In the prior art automatic performance device, however, in a case where the operator desires to restore the performance tempo to a previous tempo employed before the start of a ritardando or accelerando processing immediately upon completion of such processing (so-called "a tempo"), the operator himself must remember the value of the previous tempo before the start of such processing and, immediately upon completion of such processing, must operate the tempo setting operator to restore the current tempo value to the previous tempo value. Further, in a case where, after having changed the performance tempo during a performance, the operator desires to restore the current performance tempo to the tempo used at the start of the performance (so-called "tempo primo"), the operator must likewise remember the initial tempo value at the start of the performance and operate the tempo setting operator at a time point when he desires to restore the tempo to change the current tempo value to the initial tempo value.

In the prior art automatic performance devices, there is known a device in which a ritardando processing is synchronized with an accelerando processing and the ritardando processing is treated as being effective only during a fill-in performance so that the performance tempo is gradually decelerated only during the fill-in performance and the performance tempo is restored to a tempo employed before the ritardando processing simultaneously with completion of the fill-in performance (a tempo). In this device, however, when the ritardando processing is performed independently without synchronizing with the fill-in performance, no operation for restoring the performance tempo to a tempo before starting of the ritardando processing (a tempo) is automatically performed and, therefore, the operator must operate, in the same manner as described above, the tempo setting operator to change the current tempo to the tempo value employed before the ritardando processing immediately upon completion of the processing.

SUMMARY OF THE INVENTION

It is, therefore, an object of the invention to provide an automatic performance device which, even when a tempo changing processing such as a ritardando processing or an accelerando processing which changes the performance tempo during a performance is performed, can restore the performance tempo to an initial tempo at the start of the tempo performance or to a tempo before start of the tempo change processing.

For achieving the above described object of the invention, the automatic performance device according to the invention comprises memory means for storing performance information, performance start instruction means for instructing start of an automatic performance, performance control means for reading out the performance information from said memory means in accordance with instruction from said performance start instruction means thereby to perform the automatic performance at a predetermined tempo, storing means for storing tempo information representing a tempo at the start of the performance, tempo change instruction means for instructing change of an automatic performance tempo during the automatic performance, tempo control means for changing the automatic performance tempo in accordance with the instruction from said tempo change instruction means, tempo restoration instruction means for instructing restoration of the automatic performance tempo to the tempo at the start of the automatic performance during the automatic performance, and tempo restoration means responsive to the instruction from said tempo restoration instruction means for reading out the tempo information from said storing means and restoring the automatic performance tempo to the tempo at the start of the automatic performance on the basis of the read out tempo information.

According to the above described automatic performance device, a tempo at a time point when the performance is started is temporarily stored. Upon a tempo change instruction by the tempo change instruction means during the automatic performance, the tempo control means causes the automatic performance tempo to be changed in accordance with the tempo change instruction. Upon issuance a tempo restoration instruction in accordance with an operator's desire, the temporarily stored tempo information is read out and the automatic performance is thereby restored to a tempo at the start of the automatic performance. Accordingly, even if the operator does not remember the tempo value at the start of performance as he did in the prior art devices, the current tempo can be readily restored to the initial tempo at the start of the performance simply by instructing restoration of the tempo.

The automatic performance device according to the invention comprises memory means for storing performance information, performance control means for reading out the performance information from said memory means thereby to perform an automatic performance at a predetermined tempo, tempo change instruction means for instructing change of an automatic performance tempo during the automatic performance, tempo control means for changing the automatic performance tempo in accordance with the instruction from said tempo change instruction means, storing means for storing tempo information representing a tempo before start of the change in the tempo by said tempo control means, tempo restoration instruction means for instructing restoration of the automatic performance tempo to the tempo before the start of the tempo change processing during the automatic performance, and tempo restoration means responsive to the instruction from said tempo restoration instruction means for reading out the tempo information from said storing means and restoring the automatic performance tempo to the tempo before the start of the tempo change processing on the basis of the read out tempo information.

According to this autoamtic performance device, when the tempo change instruction means is operated, the tempo control means causes, in response to the instruction from the tempo change instruction means, an automatic performance tempo to be changed. Simultaneously, a tempo before start of tempo change is temporarily stored. Thereafter, upon issuance of the tempo restoration instruction, the temporarily stored tempo information is read out and the automatic performance thereby is restored to the tempo before the tempo change processing. Accordingly, even if the operator does not remember the tempo value before the tempo change processing as he did in the prior art devices, the current tempo can be readily restored to the tempo before the tempo change processing simply by instructing restoration of the tempo.

As to the timing of tempo restoration, the tempo may be restored immediately upon generation of the tempo restoration instruction or may be restored at a predetermined timing after generation of the tempo restoration instruction (e.g., a timing at which a bar is detected).

An embodiment of the invention will now be described below with reference to the accompanying drawings.

BRIEF DESCRIPTION OF THE DRAWINGS

In the accompanying drawings.

DESCRIPTION OF PREFERRED EMBODIMENTS

Figure 1:
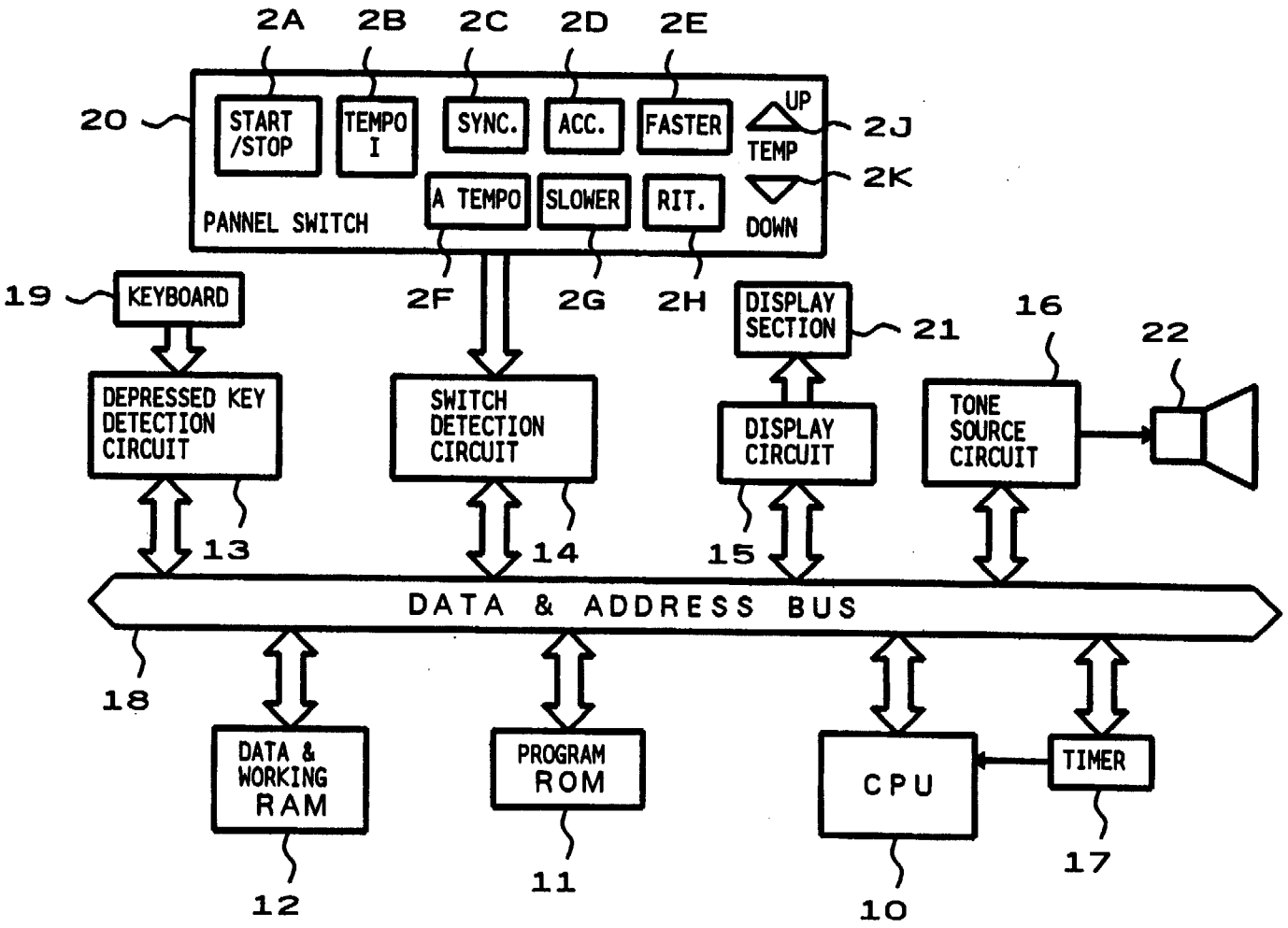
FIG. 1 is a block diagram showing a hardware structure of an electronic musical instrument incorporating an embodiment of the automatic performance device of the invention.

FIG. 1 is a block diagram showing a hardware structure of an electronic musical instrument incorporating an embodiment of the automatic performance device of the invention. In this embodiment, various processings are executed under the control of a microcomputer including a CPU 10, a program ROM 11 and a data and working RAM 12.

A microprocessor unit (CPU) 10 controls operation of the entire electronic musical instrument. To this CPU 11 are connected, through a data and address bus 18, the program ROM 11, -the data and working RAM 12, a depressed key detection circuit 13, a switch detection circuit 14, a display circuit 15, a tone source circuit 16 and a timer 17.

The program ROM 11 stores various parameters and data concerning a system program and tones of the CPU 10 and consists of a read-only memory (ROM).

The data and working RAM 12 temporarily stores performance information and various data generated when the CPU 10 executes the program. A predetermined address area in a random-access memory (RAM) is assigned for this purpose and is utilized as a register and flag.

A keyboard 19 has a plurality of keys for selecting a tone pitch of a tone to be generated and also has key switches corresponding to the respective keys. The keyboard 19 may also have, if necessary, a touch detection device such as a depressing force detection device. The keyboard 19 is a basic operator for musical performance and other type of performance operator may be employed.

The depressed key detection circuit 13 includes a key switch circuit provided in correspondence to each key in the keyboard 19 designating the tone pitch of a tone to be generated. This depressed key detection circuit 13 detects a change from a key released state to a key depressed state in the keyboard 19 and thereupon generates a key-on event and detects a change from a key depressed state to a key released state and thereupon generates a key-off event. The depressed key detection circuit 13 generates also a key code representing the tone pitch of a key relating to a key-on event or a key-off event. The depressed key detection circuit 13 additionally generates touch data upon detecting a key depressing speed or a key depressing force during deprssion of a key and outputs this touch data as velocity data. Instead of providing the depressed key detection circuit 13 and the keyboard 19, a computer may be connected to input desired performance information.

The switch detection circuit 14 is provided in correspondence to each operator (switch) provided on a panel switch 20 and produces operation data corresponding to a state of operation of each operator as event information.

The panel 'switch 20 includes various operators for selecting, setting and controlling tone color, tone pitch and effect of tones to be generated. These operators are:

A start/stop (START/STOP) switch 2A is a switch for instructing start or stop of an automatic performance. A tempo primo (TEMPO PRIMO) switch 2B is a switch for restoring the current performance tempo to an initial tempo at start of the automatic performance. A synchronizing (SYNC) switch 2C is a switch for instructing whether start of a tempo change processing should be synchronized with bar data or not.

An accelerando (ACC) switch 2D is a switch corresponding to the tempo word accelerando which means gradual acceleration of the current performance tempo. A faster (FASTER) switch 2E is a switch for accelerating the current performance tempo by a predetermined amount. An a tempo (ATEMPO) switch 2F is a switch for restoring the performance tempo to one before the tempo change processing. A slower (SLOWER) switch 2G is a switch for decelerating the current performance tempo by a predetermined amount. a ritardando (RIT) switch 2H is a switch corresponding to the tempo word ritardando which means graudal deceleration of the current performance tempo. A tempo up switch 2J and a tempo down switch 2K are switches for instructing acceleration and deceleration of the performance tempo as desired. This electronic musical instrument can accelerate or decelerate the performance tempo by operating the switch 2J or 2K. The panel switch 20 includes various other switches such as a tone color selection switch for determining a tone color of a tone to be generated and a style selection switch for determining one of performance styles such as walz and bosanova. Description of these other switches will be omitted.

The display circuit 12 displays various information including a state of control by the CPU 10 and contents of set parameters (e.g., the value of current performance tempo) in a display section 21. The display circuit 12 displays, e.g., a tone color name and an envelope shape. The display section 21 consists of a liquid crystal display panel (LCD) and the display operation of the display section 21 is controlled by the display circuit 15. The display section 21 may be one of a type in which contents of currently set parameters are all displayed or may be one in which a changed parameter only is displayed.

The tone source circuit 16 can generate tone signals simultaneously in pural channels. The tone source circuit 16 inputs performance information (data based on the MIDI standard) supplied through the data and address bus 18 and generates a tone signal on the basis of this input data.

Any type of tone signal generation system may be used in the tone source circuit 16. The tone signal generation systems which can be used in the tone source circuit 16 include, for example, the memory reading system according to which tone waveform sample value data stored in a waveform memory is sequentially read out in response to address data which changes in accordance with the tone pitch of a tone to be generated, the FM system according to which a predetermined frequency modulation operation is executed to obtain tone waveform sample value data by using the address data as phase angle parameter data, and the AM system according to which a predetermined amplitude modulation operation is executed to obtain tone waveform sample value data by using the address data as phase angle parameter data.

A tone signal generated by the tone source circuit 16 is sounded as a tone through a sound system including an unillustrated amplifier and loudspeakers.

The timer 17 generates a tempo clock pulse for setting the automatic performance tempo. The frequency of the tempo clock pulse can be set and adjusted by a tempo setting switch (not shown) on the panel switch 20. The tempo clock pulse is supplied as an interrupt instruction to the CPU 10 which performs the automatic performance processing by an interrupt processing.

The data and working RAM 12 includes therein the following registers which are used for various processings to be described later:

RUN: This is a running flag which is inverted alternately by operation of the start/stop switch 2A on the panel switch 20. When the running flag RUN is "1", it indicates that the current mode is the automatic performance mode and when the running flag RUN is "0", it indicates that the current mode is a stop mode.

TEMPO: This ia a register storing the current tempo value which has been set and changed by a tempo setting switch (not shown) on the panel switch 20. The electronic musical instrument performs the automatic performance in accordance with the tempo value stored in this tempo register TEMPO.

STEMPO: This is a start tempo register storing a tempo value during operation of the start/stop switch 2A;, i.e., the initial tempo value at the start of the automatic performance.

ATEMPO: This is an a tempo register storing a tempo value at a time when the accelerando switch 2D, faster switch 2E, slower switch 2G, ritardando switch (RIT) 2H, tempo up switch 2J and tempo down switch 2K are operated, i.e., a tempo value at the start of the tempo change processing.

UD: This is a up/down flag which indicates that the tempo switch 2J is operated when it stores "0" and that the tempo down switch 2K is operated when it stores "1".

COUNT: This is a timing counter indicating the performance position in one bar as timing data.

SYNC: This is a synchronizing mode flag which is sequentially rewritten by operation of the synchronizing switch 2C on the panel switch 20. When it is "1", it indicates that the tempo changing processing is performed in synchronism with the bar data and, when it is "0", it indicates that the tempo changing processing is performed not in synchronism with the bar data.

ACC: This is an accelerando counter storing data corresponding to performance time of the accelerando mode (a count value for two bars in this embodiment). This counter is used also as a tempo mode flag which, when this accelerando counter ACC stores a value other than "0", indicates that the performance tempo is the accelerando mode and, when the counter ACC stores "0", indicates that the performance tempo is a noraml performance tempo mode duirng which no tempo change is made.

RIT: This is a ritardando counter storing data corresponding to performance time of the ritardando mode (a count value of two bars in this embodiment). This counter RIT is used also as a tempo mode flag which, when it stores a value other than "0", indicates that the performance tempo mode is the ritardando mode and, when it stores "0", indicates that the performance tempo mode is a normal performance mode during which no tempo change is made.

NEXT: This is a mode changing register which, when it stores a value from "1" to "6", indicates that the performance tempo mode is changed to a tempo changing mode corresponding to the stored value in synchronism with next bar data and, when it stores "0", indicates taht the performance tempo mode is not changed.

In the synchronizing mode (SYNC=1), when the tempo primo switch 2D is operated, "1" is set. When the accelerando switch 2D is operated, "2" is set. When the faster switch 2E is operated, "3" is set. When the a tempo switch 2F is operated, "4" is set: When the slower switch 2G is operated, "5" is set. When the ritardando switch 2H is operated, "6" is set. Otherwise, "0" is always set.

An example of a processing by the automatic performance device executed by the microcomputer (CPU 10) will now be described with reference to the flow charts of FIGS. 2 to 13.

Figure 2:
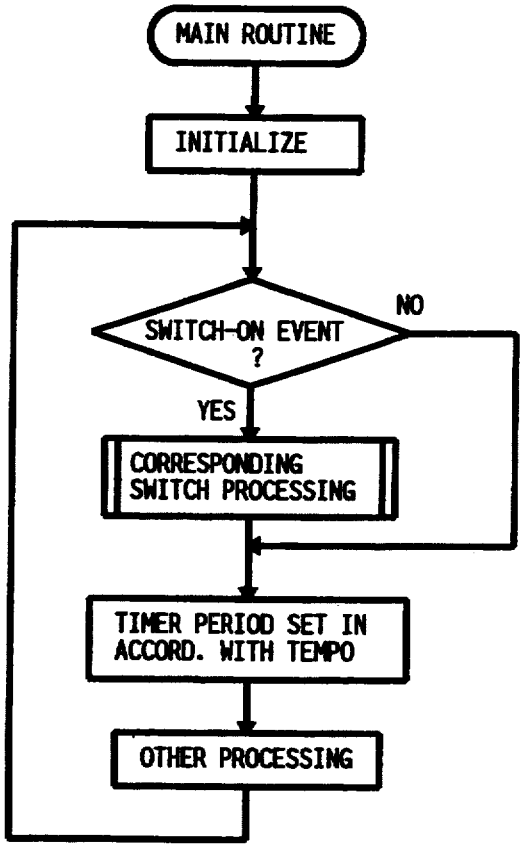
FIG. 2 is a flow chart showing an example of a main routine executed by a microcomputer of FIG. 1.

FIG. 2 shows an example of the main routine executed by the microcomputer.

Upon turning on of the power, the CPU 10 starts a processing corresponding to the control program stored in the program ROM 11. In "initialize" processing, various registers and flags in the data and working RAM 12 are initialized.

After the predetermined "initialize" processing, the switch detection circuit 14 is scanned to detect presence or absence of a switch-on event. In a case where there is a switch-on event (YES), "corresponding switch processing" corresponding to this event is performed. In a case where there is no switch-on event (NO), the frequency (timer period) of the tempo clock pulse of the timer 17 is set in accordance with the tempo value stored in the tempo register TEMPO and "other processing" is performed.

More specifically, as a result of scanning of the switch detection circuit 14, presence or absence of a switch-on event in the start/stop switch 2A, tempo primo switch 2B, synchronizing switch 2C, accelerando switch 2D, faster switch 2E, tempo switch 2F, slower switch 2G, ritardando switch 2H, tempo up switch 2J and tempo down switch 2K is detected. In a case where a switch-on event has been detected, various event processings corresponding to the detected switch-on event are performed. Examples of ths "corresponding switch processing" are shown in FIGS. 3 to 11.

First, in the "start/stop processing", the state of the running flag RUN during operation of the start/stop switch 2A is detected and a processing corresponding to the state of the running flag RUN is performed. When the running flag RUN is "0" (YES), this state indicates that the preceding state was the automatic performance stop state, so that an initial setting in preparation for the automatic performance is made. First, the value of the tempo register TEMPO is stored in the start tempo register STEMPO. The timing counter COUNT, accelerando counter ACC, ritardando counter RIT and tempo mode changing register NEXT are reset and "1" is set in the running flag RUN and then the routine returns. When the running flag RUN is "1" (NO), this state indicates that the preceding state was the automatic performance running state, so that the running flag RUN is reset to stop the automatic performance and then the routine returns.

Figure 4:
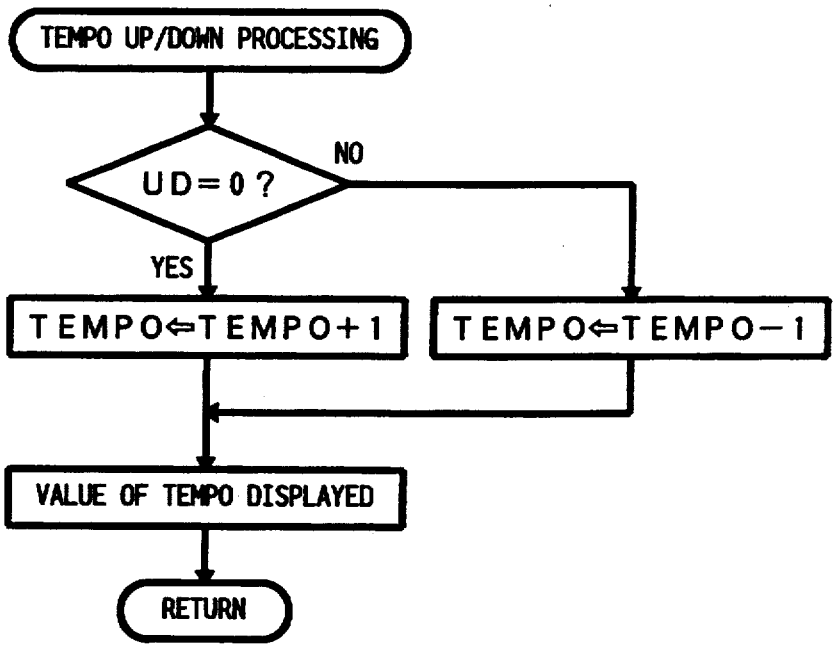
FIG. 4 is a flow chart showing an example of a tempo up/down processing in the corresponding switch processing in FIG. 2.

FIG. 4 is a flow chart showing an example of "tempo up/down processing" performed when the tempo up switch 2J or the tempo down switch 2K is operated.

In the "tempo up/down processing", the state of the up/down flag UD during operation of the tempo up switch 2J or the tempo down switch 2K is detected and a processing corresponding to the detected state is performed. When the up/down flag UD is "0" (YES), the value of the tempo register TEMPO is incremented by 1. When the up/down flag UD is "1" (NO), the value of the tempo register TEMPO is decremented by 1. The current value stored in the tempo register TEMPO is displayed in the display section 21. Therefore, by continuously depressing the tempo up switch 2J or the tempo down switch 2K, the tempo value stored in the tempo register TEMPO is continuously incremented or decremented.

Figure 5:
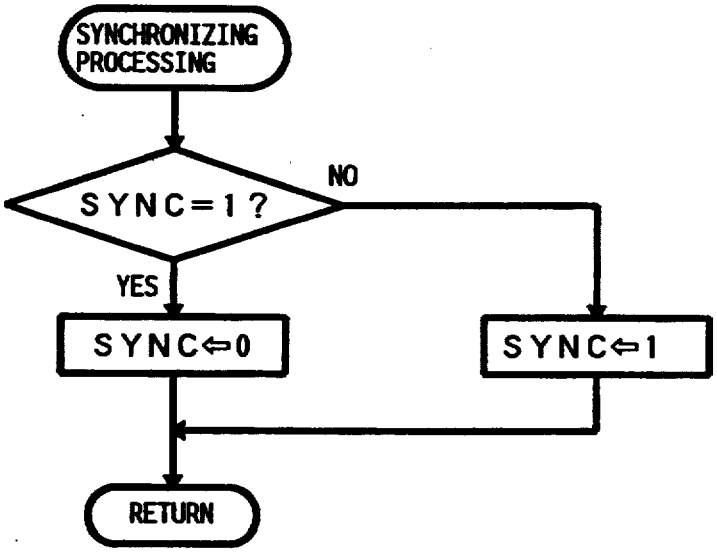
FIG. 5 is a flow chart showing an example of a sycchronizing processing the corresponding switch processing in FIG. 2.

FIG. 5 is a flow chart showing an example of "synchronizing processing" which is one of the "corresponding switch processing" in FIG. 2 and is performed when the synchronizing switch 2C is operated.

In this "synchronizing processing", the state of the synchronizing mode flag SYNC during the operation of the synchronizing switch 2C is detected and a processing corresponding to the detected state is performed. When the synchronizing mode flag SYNC is "1" (YES), "0" is stored in the synchronizing mode flag SYNC to invert and reset the synchronizing mode flag SYNC. When the synchronizing mode flag SYNC is "0" (NO), "1" is stored in the synchronizing mode flag SYNC to invert and reset the synchronizing flag SYNC. That is, in this processing, the synchronizing mode flag SYNC is inverted each time the synchronizing switch 2C is operated.

Figure 6:
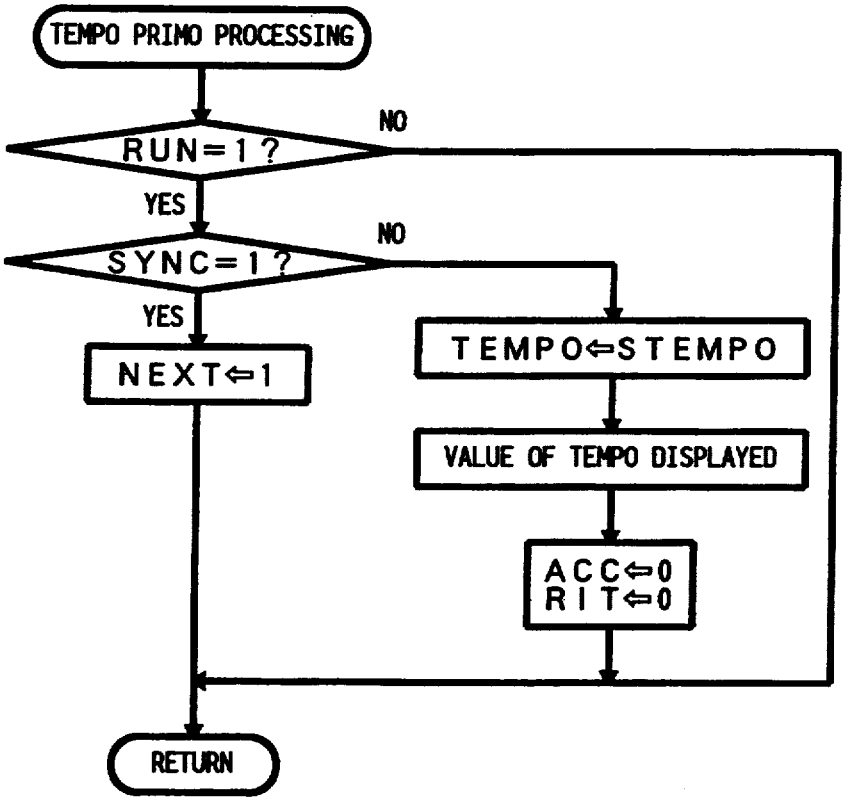
FIG. 6 is a flow chart showing an example of a tempo primo processing in the corresponding switch processing in FIG. 2.

FIG. 6 is a flow chart showing an example of "tempo primo processing" which is one the "corresponding switch processing" in FIG. 2 and is performed when the tempo primo switch 2B is operated.

In the "tempo primo processing", the state of the running flag RUN during operation of the tempo primo switch 2B is detected. When the running flag RUN is "1" (YES), a processing to be described below is peformed. When the running flag RUN is "0" (NO), this state indicates that the tempo primo switch 2B is operated notwithstanding that it is not the running state, so that the routine returns.

Figure 3:
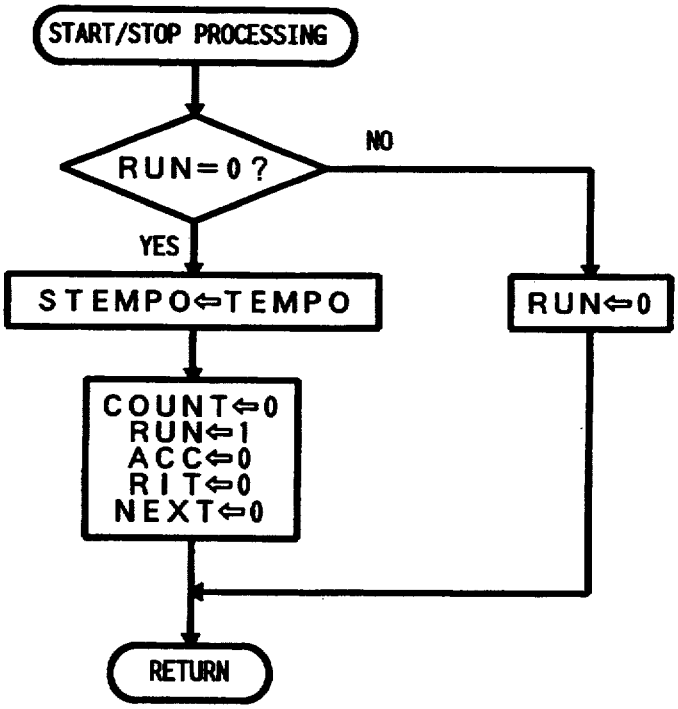
FIG. 3 is a flow chart showing an example of a start/-stop processing in a corresponding switch processing in FIG. 2.

When the synchronizing mode flag SYNC is "0" (NO), this state indicates that the synchronized performance is not performed, so that the tempo value at the start of the automatic performance stored in the start tempo register STEMPO by the start/stop processing of FIG. 3 is stored in the tempo register TEMPO and the tempo value stored in the tempo register TEMPO at this time is displayed in the display section 21. Then, for ending subsequent tempo changing processing, the accelerando counter ACC and the ritardando counter RIT are reset and the routine returns.

Conversely, when the synchronizing mode flag SYNC is "1" (YES), "1" is set in the tempo mode change register NEXT to restore the performance tempo to the tempo value at the start of the automatic performance in synchronism with next bar data and the routine returns.

Figure 7:
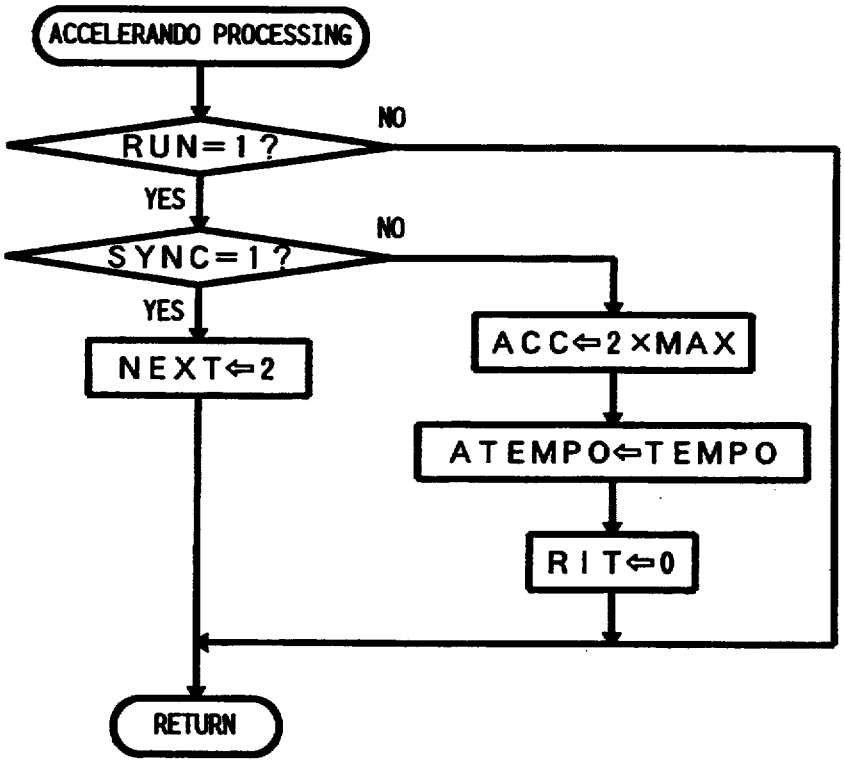
FIG. 7 is a flow chart showing an example of an accelerando processing in the corresponding switch processing in FIG. 2.

FIG. 7 is a flow chart showing an example of "accelerando processing" which is one of the "corrersponding switch processing" in FIG. 2 and is performed when the accelerando switch 2D is operated.

In the "accelerando processing", the state of the running flag RUN during operation of the accelerando switch 2D i's detected. When the running flag RUN is "1" (YES), the processing to be described below is performed and, when the running flag RUN is "0" (NO), this state indicates that the accelerando switch 2D is operated notwithstanding that it is not the running state, so that the routine returns immediately.

Then, the state of the synchronizing mode flag SYNC during the operation of the accelerando switch 2C is detected and a processing corresponding to the detected state is performed.

When the synchronizing mode flag SYNC is "0" (NO), this state indicates that the synchronized performance is not performed, so that a count of 2 bars corresponding to accelerando performance time is set in the accelerando counter ACC. In the figure, MAX represents a count of one bar, so that 2×MAX constitutes the count of 2 bars. The current tempo value stored in the tempo register TEMPO is stored in the a tempo register ATEMPO in preparation for the a tempo processing and the ritardando counter RIT is reset and the routine returns.

Conversely, when the synchronizing mode flag SYNC is "1" (YES), "2" is set in the tempo mode change register NEXT for changing the performance tempo mode to the accelerando mode in synchronism with start of next bar and the routine returns.

Figure 8:
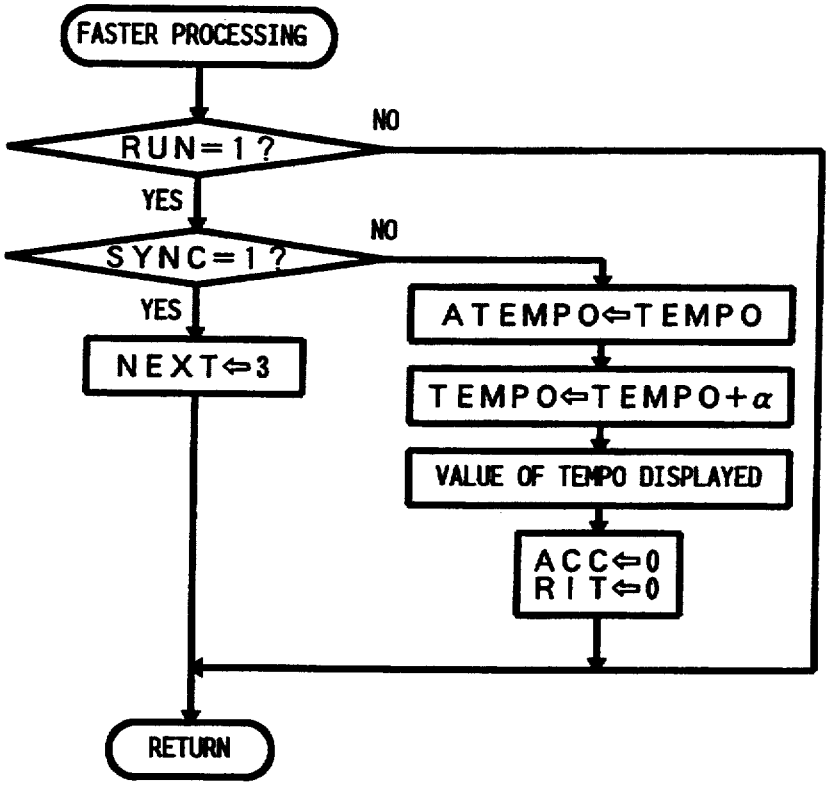
FIG. 8 is a flow chart showing an example of a faster procesing in the corresponding switch processing in FIG. 2.

FIG. 8 is a flow chart showing an example of "faster processing" which is one of the "corresponding switch processing" in FIG. 2 and is performed when the faster switch 2E is operated.

In the "faster processing", the state of the running flag RUN is detected. When the running flag RUN is "1" (YES), a processing to be described below is performed. When the running flag RUN is "0" (NO), this state indicates that the faster switch 2E is operated notwithstanding it is not the running state, so that the routine returns immediately.

When the synchronizing mode flag SYNC is "0" (NO), this state indicates that the synchronized performance is not performed, so that the current tempo value stored in the tempo register TEMPO is stored in the a tempo register ATEMPO in preparation for next a tempo processing, a predetermined value a is added to the tempo value in the tempo register TEMPO and the new tempo value stored in the tempo registre TEMPO at this time is displayed in the display section 21. Then, for ending subsequent tempo changing processing, the accelerando counter ACC and the ritardando counter RIT are reset and the routine returns.

Conversely, when the synchronizing mode flag SYNC is "1" (YES), "3" is set in the tempo mode change register NEXT for changing the performance mode to the faster mode in synchronism with start of next bar and the routine returns.

Figure 9:
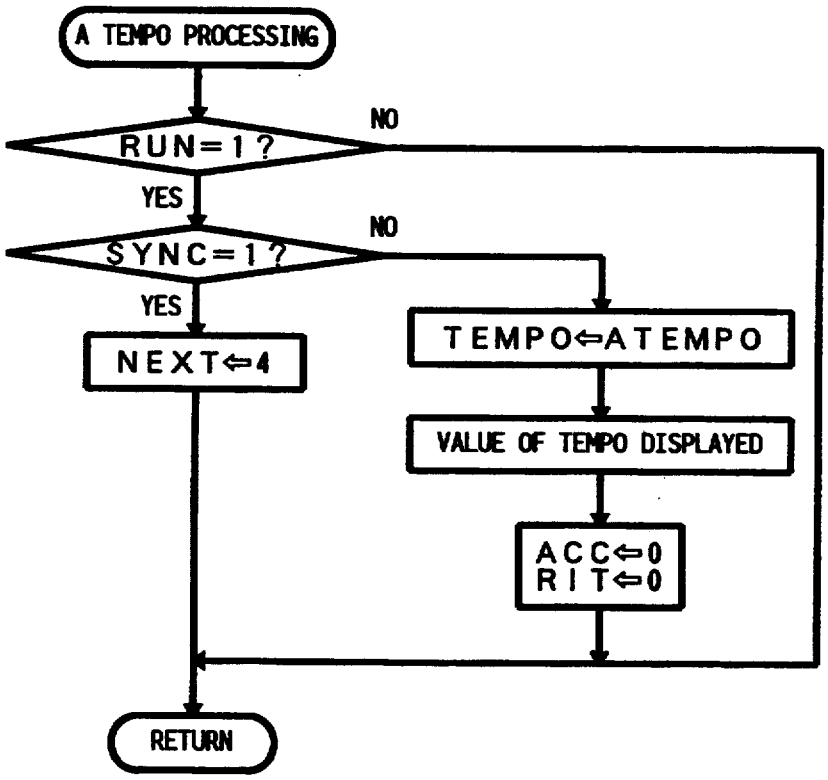
FIG. 9 is a flow chart showing an example of an a tempo processing in the corresponding switch processing in FIG. 2.

FIG. 9 is a flow chart showing an example of "a tempo processing" which is one of the "corresponding switch processing" in FIG. 2 and is performed when the a tempo switch 2F is operated.

In the "a tempo processing", the state of the running flag RUN during operation of the a tempo switch 2F is detected. When the running flag RUN is "1" (YES), a processing to be described below is performed and, when the running flag RUN is "0" (NO), this state indicates that the a tempo switch 2F is operated notwithstanding that it is not the running state, so that the routine returns immediately.

Then, the state of the synchronizing mode flag SYNC during the operation of the a tempo switch 2F is detected and a processing corresponding to the detected state is performed.

When the synchronizing mode flag SYNC is "0" (NO), this state indicates that the synchronized performance is not performed, so that the tempo value is at the start of the tempo changing processing stored in the a tempo register ATEMPO through processings of FIGS. 7, 8, 10 and 11 is stored in the tempo register TEMPO and the tempo value at this time is displayed in the display section 21. Then, for ending subsequent tempo changing processing, the accelerando confer ACC and the ritardando counter RIT are reset and the routine returns.

Conversely, when the synchronizing mode flag SYNC is "1" (YES), "4" is set in the tempo mode change register NEXT for restoring the performance tempo to the tempo value before the tempo changing processing in synchronism with next bar data and then the routine returns.

Figure 10:
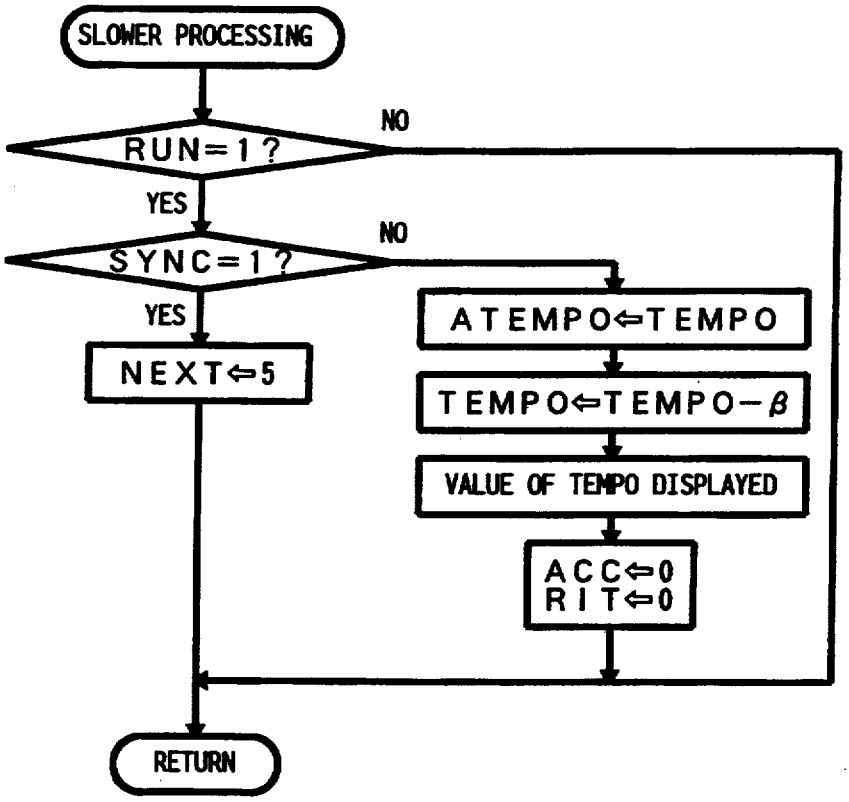
FIG. 10 is a flow chart showing an example of a slower processing in the corresponding switch processing in FIG. 2.

FIG. 10 is a flow chart showing an example of "slower processing" which is one of the "corresponding switch processing" in FIG. 2 and is performed when the slower switch 2G is operated.

In the "slower processing", the state of the runing flag RUN during operation of the slower switch 2G is detected. When the running flag RUN is "1" (YES), a processing to be described below is performed. When the running flag RUN is "0" (NO), this state indicates that the slower switch 2G is operated notwithstanding that it is not the running state, so that the routine returns immediately.

Then, the state of the synchronizing mode flag SYNC during the operation of the slower switch 2G is detected and a processing corresponding to the detected state is performed.

When the synchronizing mode flag SYNC is "0" (NO), this state indicates that the synchronized performance is not performed, so that the current tempo value stored in the tempo register TEMPO is stored in the a tempo register ATEMPO in preparation for next a tempo processing, a predetermined value b is subtracted from the tempo value in the tempo resiger TEMPO and result of the substraction is stored as a new tempo value in the tempo register TEMPO again. The new tempo value stored in the tempo register at this time is displayed in the display section 21. For ending subsequent tempo changing processing, th accelerando counter ACC and the ritardando counter RIT are reset and the routine returns.

Conversely, when the synchronizing mode flag SYNC is "1" (YES), "5" is set in the tempo mode change register NEXT for changing the performance tempo mode to the slower mode in synchronism with start of next bar and the routine returns.

Figure 11:
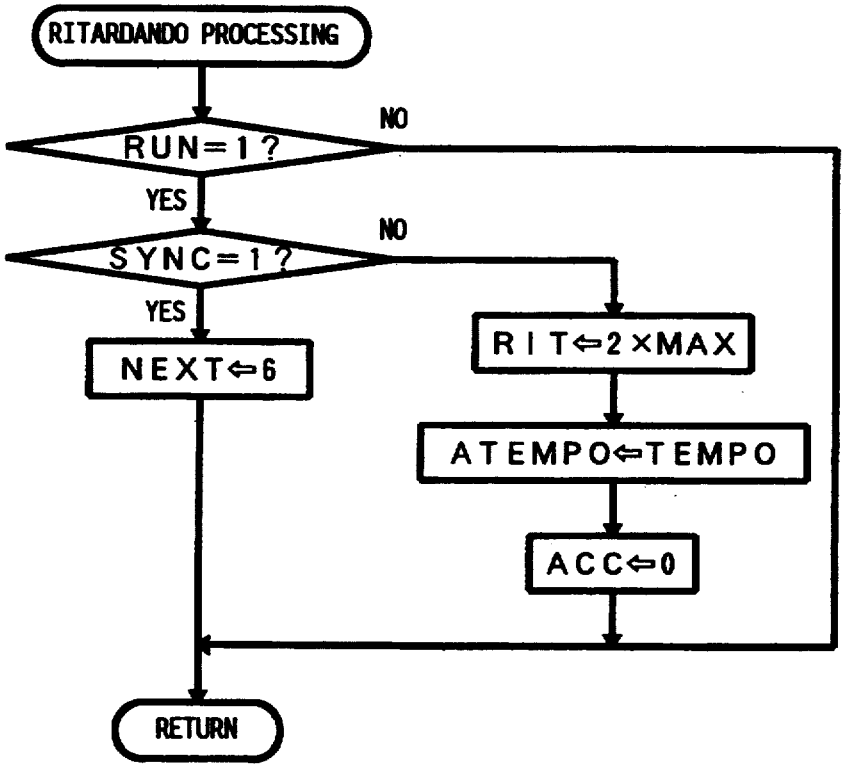
FIG. 11 is a flow chart showing an example of a ritardando processing in the corresponding switch processing in FIG. 2.

FIG. 11 is a flow chart showing an example of "ritardando processing" which is one of the "corresponding switch processing" in FIG. 2 and is performed when the ritardando switch 2H is operated.

In the "ritardando processing", the state of the running flag RUN during operation of the ritardando switch 2H is detected. When the running flag RUN is "1" (YES), a processing to be described below is performed. when the running flag RUN is "0" (NO), this state indicates that the ritardando switch 2H is operated notwithstanding that it is not the running state, so that the routine returns immediately.

Then, the state of the synchronizing mode flag SYNC during the operation of the ritardando switch 2H is detected and a processing corresponding to the detected state is performed.

When the synchronizing mode flag SYNC is "0" (NO), this state indicates that the synchronized performance is not performed, so, that a count of 2 bars corresponding to the ritardando performance time is set in the ritardando counter RIT and the current tempo value stored in the tempo register TEMPO is stored in the a tempo register A TEMPO in preparation for the a tempo processing, the accelerando counter ACC is reset and the routine returns.

Conversely, when the synchronizing mode flag SYNC is "1" (YES), "6" is set in the tempo mode change register NEXT for changing the performance tempo mode to the ritardando mode in synchronism with start of next bar.

Figure 12:
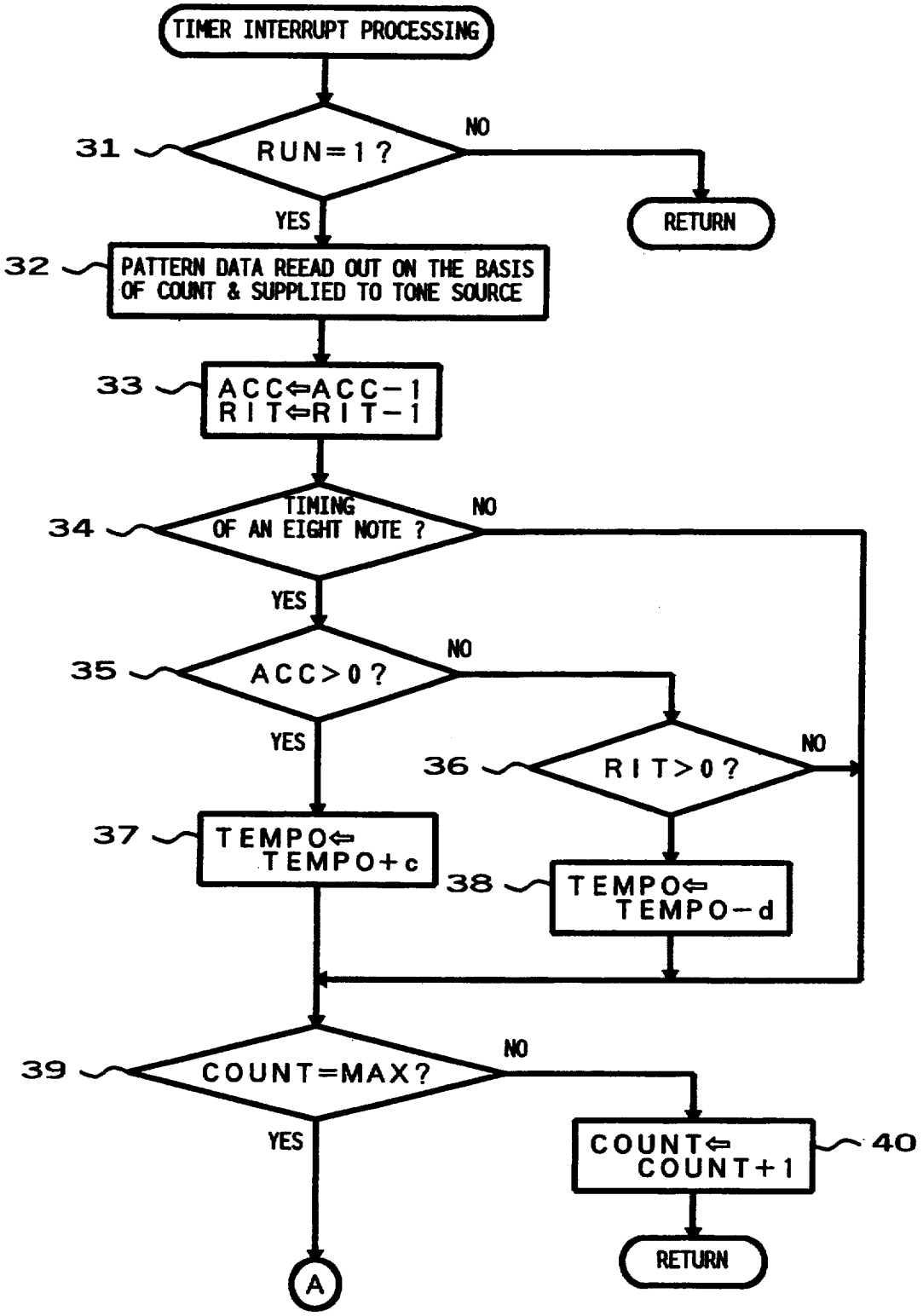
FIG. 12 is a flow chart showing a former part of a timer interrupt processing which a CPU in FIG. 1 executes each time it inputs an interrupt instruction from a timer.
Figure 13:
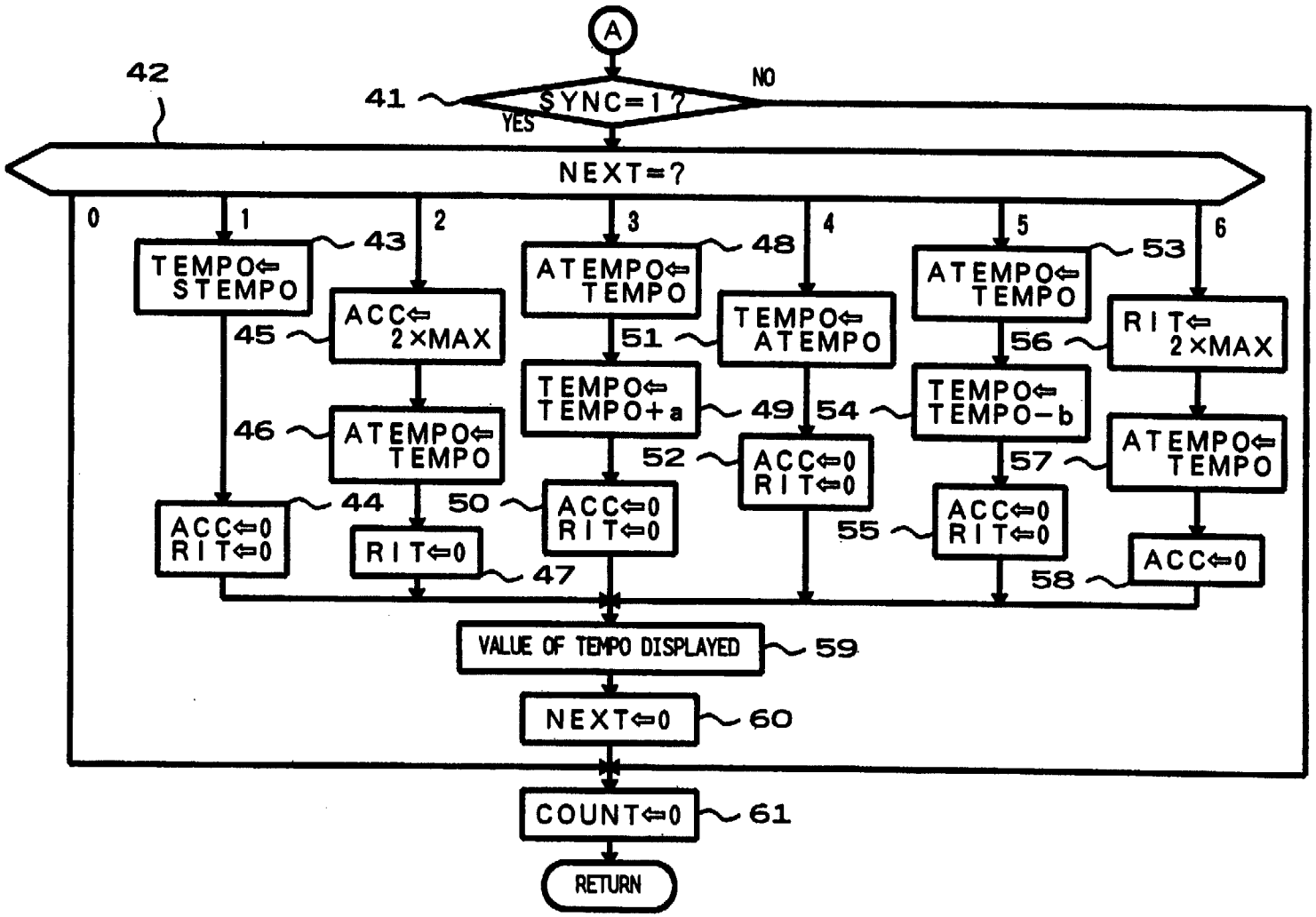
FIG. 13 is a flow chart showing a latter part of the timer interrupt processing which the CPU in FIG. 1 executes each time it inputs the interrupt instruction from the timer.

FIGS. 12 and 13 are flow charts showing in detail "timer interrupt processing" which the CPU 10 performs in response to the interrupt instruction (tempo clock) from the timer 17. In this "timer interrupt processing", whether or not the running flag RUN is "1" is detected and the interrupt processing is performed only when the running flag RUN is "1" (YES). When the running flag RUN is "0" (NO), the routine returns immediately. Steps of this processing will be described in detail below:

Step 31: Whether the running flag RUN is "1" or not, i.e., whether or not the current performance mode is the automatic performance mode, is detected. When the detected state is YES, the routine proceeds to next step 32 and, when the detected state is NO, the routine returns.

Step 32: Pattern data is read out on the basis of a timing value stored in the timing counter COUNT and is supplied to the tone source circuit 16.

Step 33: The accelerando counter ACC and the ritardando counter RIT are decremented by 1. When the value is 0, the counts of these counters ACC and RIT remain unchanged.

Step 34: Whether or not the value stored in the timing counter COUNT is a timing of generation of an eight note is detected. When the result is YES, the routine proceeds to next step 35 and, when the result is NO, the routine jumps to step 39.

Step 35: Whether or not the value stored in the accelerando counter ACC is a value larger than "0", i.e., whether it is "0" or not, is detected. When the result is "0" (NO), this state indicates that the current tempo mode is a tempo mode other than the accelerando mode, so that the routine proceeds to step 36. When the result is a value other than "0" this state indicates that the current tempo mode is the accelerando mode, so that the routine proceeds to step 37 for performing a processing corresponding to this state.

Step 36: Since it has been detected in the preceding step 35 that the count in the accelerando counter ACC is "0", whether or not the value stored in the ritardando counter RIT is a value larger than "0", i.e., whether the value is "0" or not, is detected. When the result is "0" (NO), this state indicates that the current tempo mode is the normal performance tempo mode, so that the routine proceeds to step 39. When the result is a value other than "0", this state indicates that the current tempo mode is the ritardando mode, so that the routine proceeds to step 38 for performing a processing corresponding to this state.

Step 37: Since it has been detected in the preceding step 35 that the count in the accelerando counter ACc is a value other than "0", the accelerando processing for incrementing the tempo value stored in the tempo flag TEMPO by a predetermined value c is performed in this step.

Step 38: Since it has been detected in the preceding step 36 that the count in the ritardando countre RIT is a value other than "0", the ritardando processing for decrementing the tempo value stored in the tempo flag TEMPO by a predetermined value d is performed in this step.

Step 39: Whether or not the value stored in the timing counter COUNT is equal to the maximum value MAX corresponding to one bar time, i.e., whether or not the value of the timing counter COUNT is the maximum value=95 when the time of the performed music is 4/4, or whether or not the value of the timing counter COUNT is the maximum value=71 when the time of the performed music is $\frac{3}{4}$, is detected. When the value of the timing counter COUNT is not equal to the maximum value (NO), the routine proceeds to step 40. When the value is equalt to the maximum value, the routine proceeds to step 41 of FIG. 13 through the connection symbol A.

Step 40: Since the value stored in the timing counter COUNT was not the maximum value, the count of the timing counter COUNT is incremented by 1 and the routine returns.

Step 41: The state of the synchronizing mode flag SYNC is detected. When the result is "0" (NO), this state indicates that the synchronized performance is not performed, so that the routine jumps to step 61. When the result is "1" (YES), the routine proceeds to next step 42.

Step 42: The vaue stored in the tempo mode change register NEXT is detected and a processing in one of branches in FIG. 13 corresponding to the detected result is performed. In this step, when the value of the tempo mode change register NEXt is "0", this state means that the current tempo mode is the normal tempo mode in which the tempo changing processing is not performed, so that the routine jumps to step 61. When the value is "1", this state means that the tempo primo processing is performed, so that the routine proceeds to step 43. When the value is "2", this state indicates that the accelerando processing is performed, so that the routine proceeds to step 45. When the value is "3", this state indicates that the faster processing is performed, so that the routine proceeds to step 48. When the value is "4", this state indicates that the a tempo processing is performed, so that the routine proceeds to step 51. When the value is "5", this state indicates that the slower processing is performed, so that the routine proceeds to step 53. When the value is "6", this state indicates that the ritardando processing is performed, so that the routine proceeds to step 56.

In steps 43 and 44, the tempo primo processing is performed.

Step 43: The tempo value at the start of the automatic performance stored in the start tempo register STEMPO by the start/stop processing in FIG. 3 is stored in the tempo register TEMPO.

Step 44; For ending subsequent tempo changing processing, the accelerando counter ACC and the ritardando counter RIT are reset and the routine proceeds to step 59.

In steps 45 to 47, the accelerando processing is performed.

Step 45: A count of 2 bars corresponding to the accelerando performance time is set in the accelerando counter ACC.

Step 46: The current tempo value stored in the tempo register TEMPO is stored in the a tempo register ATEMPO in preparation for the a tempo processing.

Step 47: The ritardando counter RIt is reset and the routine proceeds to step 59.

In steps 48 to 50, the faster processing is performed.

Step 48: The current tempo value stored in the tempo register TEMPO is stored in the a tempo register ATEMPO in preparation for next a tempo processing.

Step 49: A predetermined value a is added to the tempo value in the tempo register TEMPO and the result of the addition is stored as a new tempo value in the tempo register TEMPO again.

Step 50: For ending subsequent tempo changing processing, the accelerando counter ACC and the ritardando counter RIT are reset and the routine proceeds to step 59.

In steps 51 and 52, the a tempo processing is performed.

Step 51: The tempo value at the start of the tempo changing processing stored in the a tempo register ATEMPO is stored in the tempo register TEMPO.

Step 52: For ending subsequent tempo changing processing, the accelerando counter ACC and the ritardando counter RIT are reset and the routine proceeds to step 59.

In steps 53 to 55, the slower processing is performed.

Step 53: The current tempo value stored in the tempo register TEMPO is stored in the a tempo register ATEMPO in preparation for next a tempo processing.

Step 54: A predetermined value b is subtracted from the tempo value in the tempo register TEMPO and the result of the subtraction is stored as a new tempo value in the tempo register TEMPO again.

Step 55: For ending subsequent tempo changing processing, the accelerando counter ACC and the ritardando counter RIT are reset and the routine proceeds to step 59.

In steps 56 to 58, the ritardando processing is performed.

Step 56: A count of 2 bars corresponding to the ritardando performance time is set in the ritardando counter RIT.

Step 57: The current tempo value stored in the tempo register TEMPO is stored in the a tempo register ATEMPO in preparation for the a tempo processing.

Step 58: The accelerando counter ACC is reset and the routine proceeds to step 59.

Steps 59 to 61 are performed commonly for the above described processings.

Step 59: The tempo value stored in the tempo register TEMPO is displayed in the display section 21.

Step 60: The tempo mode change register NEXT is reset.

Step 61: The timing counter COUNT is reset.

An example of operation of this embodiment will be described with reference to FIGS. 14A and 14B.

Figure 14B:
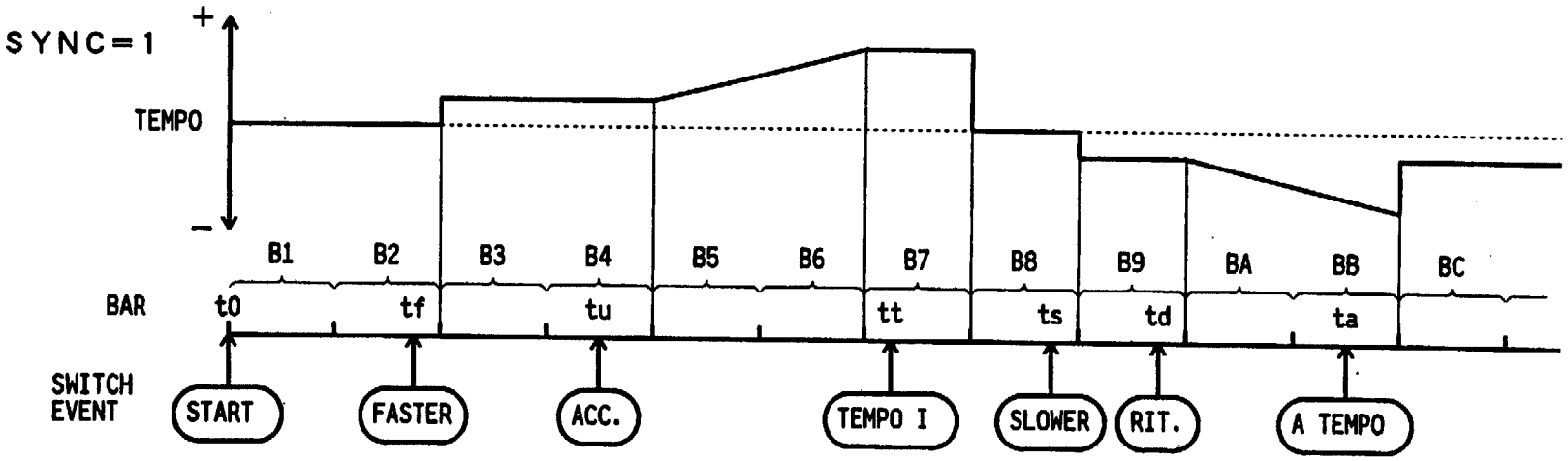
FIGS. 14A and 14B are diagrams showing an example of operation of the electronic musical instrument according to the invention with reference to a relation between bar data and tempo.
Figure 14A:
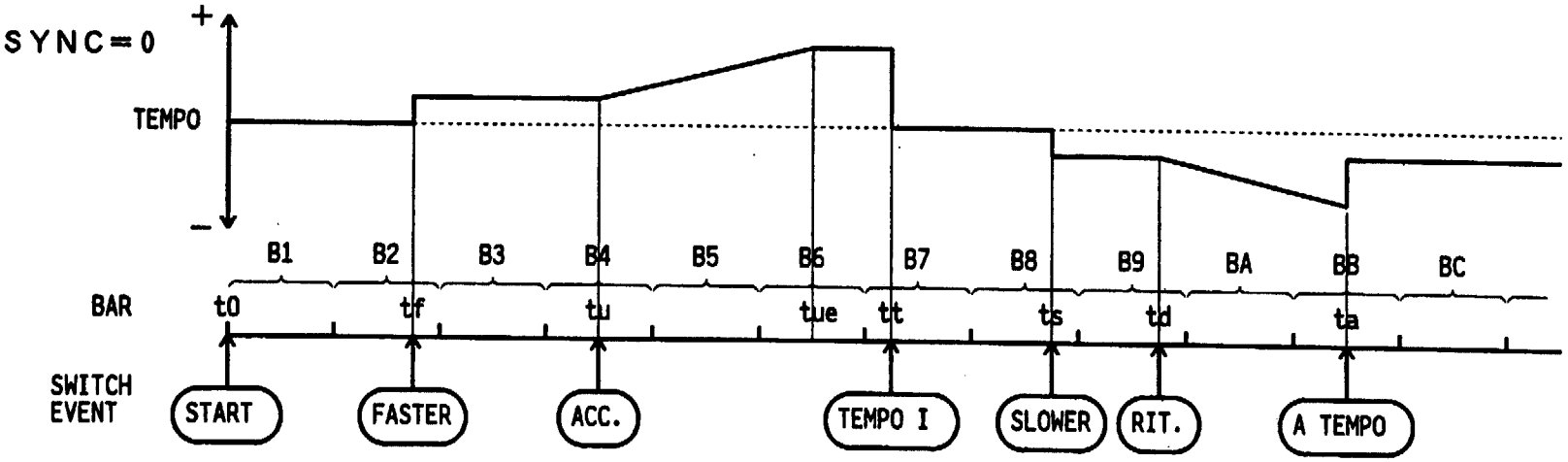

FIGS. 14A and 14B are diagrams showing relation between bar data and current performance tempo when various switches are operated (turned on). FIG. 14A shows a case where the tempo changing processing is performed when the synchronzing mode flag SYNC is 0, i.e., the switch is operated regardless of generation of bar data. FIG. 14B shows a case where the synchronizing mode switch SYNC=1, i.e., the tempo changing processing is performed in synchronism with generation of the bar data.

In FIGS. 14A and 14B, it is assumed that the start/stop (START/STIP) switch 2A is operated at a first time point t0 in the first bar B1, the faster (FASTER) switch 2E at a time point tf in the second bar B2, the accelerando (ACC) switch 2D at a time point tu in the fourth bar B4, the tempo primo (TEMPO I) switch 2B at a time point tt in the seventh bar B7, the slower (SLOWER) switch 2G at a time point ts in the eighth bar BS, the ritardando (RIT) switch 2H at a time point td in the ninth bar B9 and the a tempo (A TEMPO) switch 2F at a time point ta in the eleventh bar BB, respectively in time sequence.

Referring first to FIG. 14A, the case of the synchronizing mode SYNC=0 will be described.

When the start/stop (START/STOP) switch 2A is operated at th time point t0 in the first bar B1, the electronic musical instrument stores the value of the tempo register TEMPO in the start tempo register STEMPO, resets the timing counter COUNT, accelerando counter ACC, ritardando counter RIT and tempo mode change register NEXT and sets "1" in the running flag RUN.

When the faster switch 2E is operated at the time point tf in the second bar B2, the electronic musical instrument repeatedly performs steps 31–36, 39–41 and 61 in FIGS. 12 and 13 by the timer interrupt processing and makes performance with a tempo at the start of the performance.

When the faster switch 2E is operated at the time point tf in the second bar 2B, the electronic musical instrument performs the faster processing in FIG. 8. In this case, the synchronizing mode flag SYNC is 0 and the synchronized performence is not performed. The current tempo value stored in the tempo register TEMPO is stored in the a tempo register ATEMPO in preparation for the a tempo processing, a predetermined value a is added to the tempo value of the tempo register TEMPO, the result of the addition is stored as a new tempo value in the tempo register TEMPO again, and the acclelerando counter ACC and the ritardando counter RIT are reset.

Until the accelerando switch 2D is operated at the time point tu in the fourth bar B4, the electronic musical instrument repeatedly performs stesp 31–36, 39–41 and 61 of FIGS. 12 and 13 by the timer interrupt processing and carries out performance with a performance tempo which is incremented from the tempo at the start of performance by the predetermined value a.

When the accelerando switch 2D is operated at the time point tu in the fourth bar B4, the electronic musical instrument carries out the accelerando processing of FIG. 7. Since the synchronized performance is not made in this case, a count of 2 bars=2×MAX corresponding to the accelerando performance time is stored in the accelerando counter ACC, the current tempo value stored in the tempo register TEMPO is stored in the a tempo register ATEMPO and the ritardando counter RIT is reset. In other words, at this time point, the tempo value obtained by adding the predetermined value a to the tempo at the start of performance by the preceding faster processing is stored in the a tempo register ATEMPO.

During a time period from the time point tu in the fourth bar B4 till a time point rue which is 2 bars time later, the electronic musical instrument repeatedly performs steps 31–35, 39–41 and 61 of FIGS. 12 and 13 by the timer interrupt processing and carries out performance by gradually incrementing the performance tempo by the predetermined value c, i.e., performing the accelerando processing. At the time point rue, the electronic musical instrument maintains the tempo value and performs stesp 31–36, 39–41 and 61 in FIGS. 12 and 13 by the timer interrupt processing, carrying out performance with the tempo at the time point when the accelerando processing ended until the tempo primo switch 2B is operated at the time point tt in the seventh bar B7.

When the tempo primo switch 2B is operated at the time point tt in the seventh bar B7, the electronic musical instrument carries out the tempo primo processing of FIG. 6. Since the synchronized performance is not performed in this case, the tempo value at the start of the automatic performance stored in the start tempo register STEMPO by the start/stop processing at the time point t0 is stored in the tempo register TEMPO and the accelerando counter AC and the ritardando counter RIT are reset and the routine returns.

Until the slower switch 2G is operated at the time point ts in the eighth bar BS, the electronic musical instrument repeatedly performs steps 31–36, 39–41 and 61 of FIGS. 12 and 13 by the timer interrupt processing and carries out the performance again with the tempo at the start of performance.

When the slower switch 2G is operated at the time point ts in the eighth bar BS, the electronic musical instrument carries out the slower processing of FIG. 10. Since the synchronized performance is not performed in this case, the current tempo value stored in the tempo register TEMPO is stored in the a tempo register ATEMPO in preparation for the a tempo processing and the predetermined value b is subtracted from the tempo value in the tempo register TEMPO. The result of the subtraction is stored as a new tempo value in the tempo register TEMPO again and the accelerando counter ACC and the ritardando counter RIT are reset.

Accordingly, until the ritardando switch 2H is operated at the time point td in the ninth bar B9, the electronic musical instrument repeatedly performs steps 31–36, 39–41 and 61 in FIGS. 12 and 13 by the timer interrupt processing and carris out the performance with the tempo which is decremented by the predetermined value b from the tempo at the start of the performance.

When the ritardando switch 2H is operated at the time point td in the ninth bar B9, the electronic musical instrument performs the ritardando processing of FIG. 11. Since the synchronized performance is not performed in this case, a count of 2 bars=2×MAX corresponding to the ritardando performance time is stored in the ritardando counter RIT, the current tempo value stored in the tempo register TEMPO is stored in the a tempo register ATEMPO and the accelerando counter ACC is reset. In other words, at this time point, a tempo value obtained by subtracting the predetermined value b from the tempo at the start of the performance by the preceding slower processing is stored in the a tempo register ATEMPO.

During a time period of 2 bars time from the time point td, the electronic musical instrument repeatedly performs steps 31–36, 38–41 and 61 in FIGS. 12 and 13 and carries out the performance with the tempo in which the predetermined value b is gradually decremented, i.e., performing the ritardando processing. However, since the a tempo switch 2F is operated at the time point ta in the eleventh bar BB at which 2 bars time has not elapsed from the time point td yet, the electronic musical instrument performs the a tempo processing of FIG. 9. Since the synchronized performance is not made in this case, the tempo value at the start of the tempo changing processing stored in the a tempo register ATEMPO by the ritardando processing of FIG. 11 (i.e., the tempo value obtained by subtracting the predetermined value b from the tempo at the start of the performance) is stored in the tempo register TEMPO and the performance is made by using this tempo as a new tempo. For ending subsequent tempo changing processing (the ritardando processing in this case), the accelerando counter ACC and the ritardando counter RIT are reset.

The electronic musical instrument repeatedly performs steps 31–36, 39–41 and 61 in FIGS. 12 and 13 by the timer interrupt processing while maintaining this tempo (i.e., the tempo obtained by subtracting the predetermined value b from the tempo at the start of the performance) after the time point ta.

Referring now to FIG. 14B, the case of the synchronizing mode SYNC=1 will be described.

When the start/stop (START/STOP) switch 2A is operated at the time point t0 in the first bar B1, the electronic musical instrument stores, in the same manner as in the above described case of FIG. 14A, the value of the tempo register TEMPO in the start tempo register STEMPO, resets the timing counter COUNT, accelerando counter ACC, ritardando counter RIT and tempo mode change register NEXT, and sets "1" in the running flag RUN. During a time period from the time point t0 till the time point tf when the faster switch 2E is operated, the electronic musical instrument repeatedly performs steps 31–36, 39 and 40 in FIG. 12 by the timer interrupt processing and carries out performance with the tempo at the start of the performance.

At the time point at which the second bar B2 has ended (when the timing counter COUNT=MAX is detected in step 39 in FIG. 12), the electronic musical instrument carries out steps 48–50 and 59–61 in FIG. 13. That is, the current tempo value stored in the tempo register TEMPO is stored in the a tempo register ATEMPO in preparation for the a tempo processing, the predetermined value a is added to the tempo value in the tempo register TEMPO, the result of the addition is stored as a new tempo value in the tempo register TEMPO again and the accelerando counter ACC is reset. During a time period from the start of the third bar B3 till the time point tu when the accelerando switch 2D is operated, the electronic musical instrument performs steps 31–36, 39–42 and 61 by the timer interrupt processing and carries out performance with the tempo which is incremented by the predetermined value a from the tempo at the start of performance.

The operation of the electronic musical instrument in the case of SYNC=1 is the same as in the case of SYNC=0 except that in the case of SYNC=1, processings of the respective switches are performed in synchronism not with the time point when these switches are operated but with timing of next bar. Therefore, description of the other operation will be omitted.

In the above described embodiment, as shown in steps 34–38 in FIG. 12, the ritardando processing and the accelerando processing are performed at the timing of eight note. The tempo may be changed at a timing of a finer timer interrut processing (minimum resolution of the automatic performance). That is, step 34 may be omitted.

In the above described embodiment, description has been made about a case where all tempo changing processings are performed in synchronism or not in synchronism with a bar in accordance with the synchronizing mode or the non-synchronizing mode. The invention however is not limited to this but a specific tempo changing processing only may be changed in synchronism with a bar. For example, the tempo up processing or the tempo down processing only may be synchronized with a bar and the other processings may not be synchronized with a bar. The type of processing which is synchronized or not synchronized may also be selected in a suitable manner.

In the above described embodiment, description has been made about a case where the predetermined value c or d is added in the case of the ritardando or accelerando processing. The invention is not limited to this but a value smaller than 1 may be multiplied in the case of the ritardando processing whereas a value larger than 1 may be multiplied in the case of the accelerando processing. Alternatively, the tempo values may be divided by a value larger than 1 in the case of the ritardando processing and by a value smaller than 1 in the case of the accelerando processing. The rate of change in the ritardando or accelerando processing (the predetermined value c or d) may be changed in accordance with the number of times of operation of the ritardando switch 2H or the accelerando switch 2D.

The invention is applicable not only to the rhythm performance but to automatci performances such as automatic bass performance and automatic chord performance, normal sequencer automatic performance and performance by outputting tempo control data such as MIDI clock.

In a case where the same ritardando switch 2F or the accelerando switch 2D is operated during the ritardando processing or the accelerando processing, the tempo change may be stopped and the tempo at the time point of the operation of the switch may be maintained. By doing so, variation in the tempo change can be further increased. In this case, a switch used exclusively for stopping the tempo change may be provided or such processing may be performed by operating the tempo up switch 2J during the ritardando processing or by operating the tempo down switch 2K during the accelerando processing.

According to the invention, in a case where a tempo changing processing for changing the performance tempo during performance such as the ritardando processing or the accelerando processing is performed, the performance tempo can be restored to the tempo value at the start of performance or the tempo value before the tempo changing processing.

What is claimed is:

1. An automatic performance device comprising:

memory means for storing automatic performance information;

performance start instruction means for generating an instruction to start an automatic performance;

performance control means for reading out the automatic performance information from said memory means in accordance with the instruction from said performance start instruction means thereby to perform the automatic performance information at a predetermined tempo;

storing means for storing tempo information representing an automatic performance tempo at the start of the automatic performance;

tempo change instruction means for generating an instruction to change the automatic performance tempo during the automatic performance of the automatic performance information at the automatic performance tempo;

tempo control means for changing the automatic performance tempo in accordance with the instruction from said tempo change instruction means;

tempo restoration instruction means for generating an instruction to restore the automatic performance tempo during the automatic performance of the automatic performance information to the automatic performance tempo employed at the start of the automatic performance during the automatic performance of the automatic performance information; and tempo restoration means responsive to the instruction from said tempo restoration instruction means for reading out the tempo information from said storing means and restoring the automatic performance tempo during the automatic performance of the automatic performance information to the automatic performance tempo employed at the start of the automatic performance on the basis of the read out tempo information.

2. An automatic performance device as defined in claim 1 wherein said tempo change instruction means instructs one of ritardando and accelerando and said tempo control means causes the tempo to change gradually for a predetermined period of time in accordance with this instruction.

3. An automatic performance device as defined in claim 1 wherein said tempo change instruction means instructs change of the tempo by a predetermined amount and said tempo control means shifts the tempo under performance by a predetermined amount in accordance with this instruction.

4. An automatic performance device as defined in claim 1 wherein said performance control means reads out the performance information at each predetermined timing corresponding to the tempo and said tempo control means changes this predetermined timing.

5. An automatic performance device as defined in claim 1 which further comprises display means for displaying the tempo which has been changed by said tempo control means and said restoration means.

6. An automatic performance device comprising:

memory means for storing automatic performance information;

performance control means for reading out the automatic performance information from said memory means thereby to perform an automatic performance of the automatic performance information at a predetermined tempo;

tempo change instruction means for generating an instruction to change an automatic performance tempo during the automatic performance of the automatic performance information at the automatic performance tempo;

tempo control means for changing the automatic performance tempo in accordance with the instruction from said tempo change instruction means;

storing means for storing tempo information representing the automatic performance tempo employed before start of the change in the automatic performance tempo by said tempo control means;

tempo restoration instruction means for generating an instruction to restore the automatic performance tempo during the automatic performance of the automatic performance information to the automatic performance tempo employed before the start of the tempo change during the automatic performance of the automatic performance information; and tempo restoration means responsive to the instruction from said tempo restoration instruction means for reading out the tempo information from said storing means and restoring the automatic performance tempo during the automatic performance of the automatic performance information to the automatic performance tempo performed before the start of the tempo change on the basis of the read out tempo information.

7. An automatic performance device as defined in claim 6 wherein said tempo change instruction means instructs one of ritardando and accelerando and said tempo control means causes the tempo to change gradually for a predetermined period of time in accordance with this instruction.

8. An automatic performance device as defined in claim 6 wherein said tempo change instruction means instructs change of the tempo by a predetermined amount and said tempo control means shifts the tempo under performance by a predetermined amount in accordance with this instruction.

9. An automatic performance device as defined in claim 6 wherein said performance control means reads out the performance information at each predetermined timing corresponding to the tempo and said tempo control means changes this predetermined timing.

10. An automatic performance device as defined in claim 6 which further comprises display means for displaying the tempo which has been changed by said tempo control means and said restoration means.

11. An automatic performance device comprising:

memory means for storing automatic performance information;

performance control means for reading out the automatic performance information from said memory means thereby to perform an automatic performance of the automatic performance information at a predetermined tempo;

tempo change instruction means for generating an instruction to change an automatic performance tempo during the automatic performance of the automatic performance information at the automatic performance tempo;

tempo control means for changing the automatic performance tempo in accordance with the instruction from said tempo change instruction means;

storing means for storing tempo information representing the automatic performance tempo before a tempo change by said tempo control means;

tempo restoration instruction means for generating an instruction to restore the automatic performance tempo during the automatic performance of the automatic performance information to the automatic performance tempo employed before the tempo change; and tempo restoration means responsive to the instruction from said tempo restoration instruction means for reading out the tempo information from said storing means and restoring the automatic performance tempo during the automatic performance of the automatic performance information to the automatic performance tempo employed before the tempo change at a predetermined timing after said instruction from said tempo restoration instruction means.

12. An automatic performance device as defined in claim 11 wherein said tempo restoration means restores the automatic performance tempo to the tempo at a bar timing after the tempo restoration instruction.

13. An automatic performance device as defined in claim 11 wherein said tempo restoration means restores the automatic performance tempo to a tempo employed before start of the automatic performance.

14. An automatic performance device as defined in claim 11 wherein said tempo restoration means restores the automatic performance tempo to a tempo employed immediately before the change in the tempo.

15. An automatic performance device as defined in claim 11 which further comprises mode instruction means for instructing one of a first mode in which the tempo is restored in accordance with said tempo restoration instruction and a second mode in which the tempo is restored at a predetermined timing after said tempo restoration instruction.

16. A method of changing an automatic performance tempo in an automatic performance device, the method comprising the steps of:

storing automatic performance information;

generating an instruction to start an automatic performance;

reading out the automatic performance information in response to the start instruction;

performing the automatic performance information at a predetermined tempo;

storing tempo information representing the automatic performance tempo at the start of the automatic performance;

generating an instruction to change the automatic performance tempo during the automatic performance of the automatic performance information at the automatic performance tempo;

changing the automatic performance tempo in response to the change instruction;

generating an instruction to restore the automatic performance tempo during the automatic performance of the automatic performance information to the automatic performance tempo employed at the start of the automatic performance during the automatic performance of the automatic performance information;

reading out the stored tempo information; and restoring the automatic performance tempo in response to the restore instruction during the automatic performance of the automatic performance information to the automatic performance tempo employed at the start of the automatic performance on the basis of the read out tempo information.

17. A method of changing an automatic performance tempo in an automatic performance device, the method comprising the steps of:

storing automatic performance information;

reading out the automatic performance information;

performing an automatic performance of the automatic performance information at a predetermined tempo;

generating an instruction to change the automatic performance tempo during the automatic performance of the automatic performance information at the automatic performance tempo;

changing the automatic performance tempo in response to the change instruction;

storing tempo information representing the automatic performance tempo employed before changing the automatic performance tempo;

generating an instruction to restore the automatic performance tempo during the automatic performance of the automatic performance information to the automatic performance tempo employed before the changing the automatic performance tempo during the automatic performance of the automatic performance information;

reading out the tempo information; and restoring the automatic performance tempo in response to the restore instruction during the automatic performance of the automatic performance information to the automatic performance tempo performed before changing the automatic performance tempo on the basis of the read out tempo information.

18. A method of changing an automatic performance tempo in an automatic performance device, the method comprising the steps of:

storing automatic performance information;

reading out the automatic performance information;

performing an automatic performance of the automatic performance information at a predetermined tempo;

generating an instruction to change the automatic performance tempo during the automatic performance of the automatic performance information at the automatic performance tempo;

changing the automatic performance tempo in response to the change instruction;

storing tempo information representing the automatic performance tempo before changing the automatic performance tempo;

generating an instruction to restore the automatic performance tempo during the automatic performance of the automatic performance information to the automatic performance tempo employed before changing the automatic performance tempo;

reading out the tempo information; and restoring the automatic performance tempo in response to the restore instruction during the automatic performance of the automatic performance information to the automatic performance tempo employed before changing the automatic performance tempo at a predetermined timing after said restoring instruction.

* * * * *